US008552865B2

(12) United States Patent
Zhao et al.

(10) Patent No.: US 8,552,865 B2
(45) Date of Patent: Oct. 8, 2013

(54) SELF-TEST METHOD FOR A MICROWAVE MODULE

(75) Inventors: Tianfeng Zhao, Shenzhen (CN); Mingzhi Xzao, Shenzhen (CN); Lei Qin, Shenzhen (CN); Hansen Gu, Shenzhen (CN)

(73) Assignee: Honeywell International Inc., Morristown, NJ (US)

( * ) Notice: Subject to any disclaimer, the term of this patent is extended or adjusted under 35 U.S.C. 154(b) by 348 days.

(21) Appl. No.: 12/950,958

(22) Filed: Nov. 19, 2010

(65) Prior Publication Data

US 2012/0126980 A1 May 24, 2012

(51) Int. Cl.
*G08B 13/18* (2006.01)

(52) U.S. Cl.
USPC ..... 340/554; 340/552; 340/553; 340/531; 340/506; 340/508; 342/28; 342/110; 342/114; 342/115

(58) Field of Classification Search
USPC ..... 340/554, 552, 553, 531, 508, 506; 342/28, 110, 114, 115
See application file for complete search history.

(56) References Cited

U.S. PATENT DOCUMENTS 5,986,600 A * 11/1999 McEwan ..... 342/28
6,239,736 B1 * 5/2001 McDonald et al. ..... 342/28
7,541,923 B2 * 6/2009 Chien ..... 340/541

* cited by examiner

*Primary Examiner* — Tai T Nguyen
(74) *Attorney, Agent, or Firm* — Husch Blackwell LLP

(57) ABSTRACT

A method and apparatus are provided for automatically testing microwave instruction detection modules of a security system. The method includes the steps of detecting intruders within a protected space by monitoring a Doppler output of a signal extraction circuit coupled to a microwave transceiver module, varying a frequency of direct current power pulses applied to the microwave transceiver module, detecting a difference in magnitude of the Doppler output of the signal extraction circuit over the varied frequency and comparing the detected difference with a fault threshold level.

20 Claims, 12 Drawing Sheets

SELF-TEST METHOD FOR A MICROWAVE MODULE

FIELD OF THE INVENTION

The present invention relates to surveillance systems for detecting intruders using microwaves in a monitored area or space, and particularly to a self-checking method for testing a microwave module and its hardware circuit. More specifically, the method relates to the periodic self-testing of the microwave module and its circuit, and through the self-testing to ensure the normal functioning of the detector in order to avoid failure. So, the invention provides an auto-detection method for failure of the microwave module and its hardware circuit, and it can achieve the self-check function efficiently and ensure the effectiveness of detector installation.

BACKGROUND OF THE INVENTION

Security systems are generally known. Such systems may be used in homes or offices or even in industrial settings to detect intruders.

Many different types of intrusion detectors are in use. In its simplest form, an intrusion detector may simply be an electrical switch that detects an intruder by sensing the unauthorized opening of a door.

In more sophisticated systems, intrusion may be based upon the direct detection of intruders within a protected space. In this regard, many security systems use intrusion detectors based on microwaves and upon a microwave sensing technology that detects the movement of people (objects). However, to ensure the properly functioning of the microwave detectors and its hardware circuit while detecting intrusions, it is often necessary to include a periodic auto-monitoring function (i.e., a self-checking function). If the function finds an abnormality in the microwave module or its hardware circuit, then the function give a warning or reminder of the failure, to notify a user that the detector need to be replaced or repaired. The technical difficulty in such cases becomes the question of how to correctly self-test the microwave intrusion detector without triggering false alarms.

DETAILED DESCRIPTION OF AN ILLUSTRATED EMBODIMENT

Figure 1:
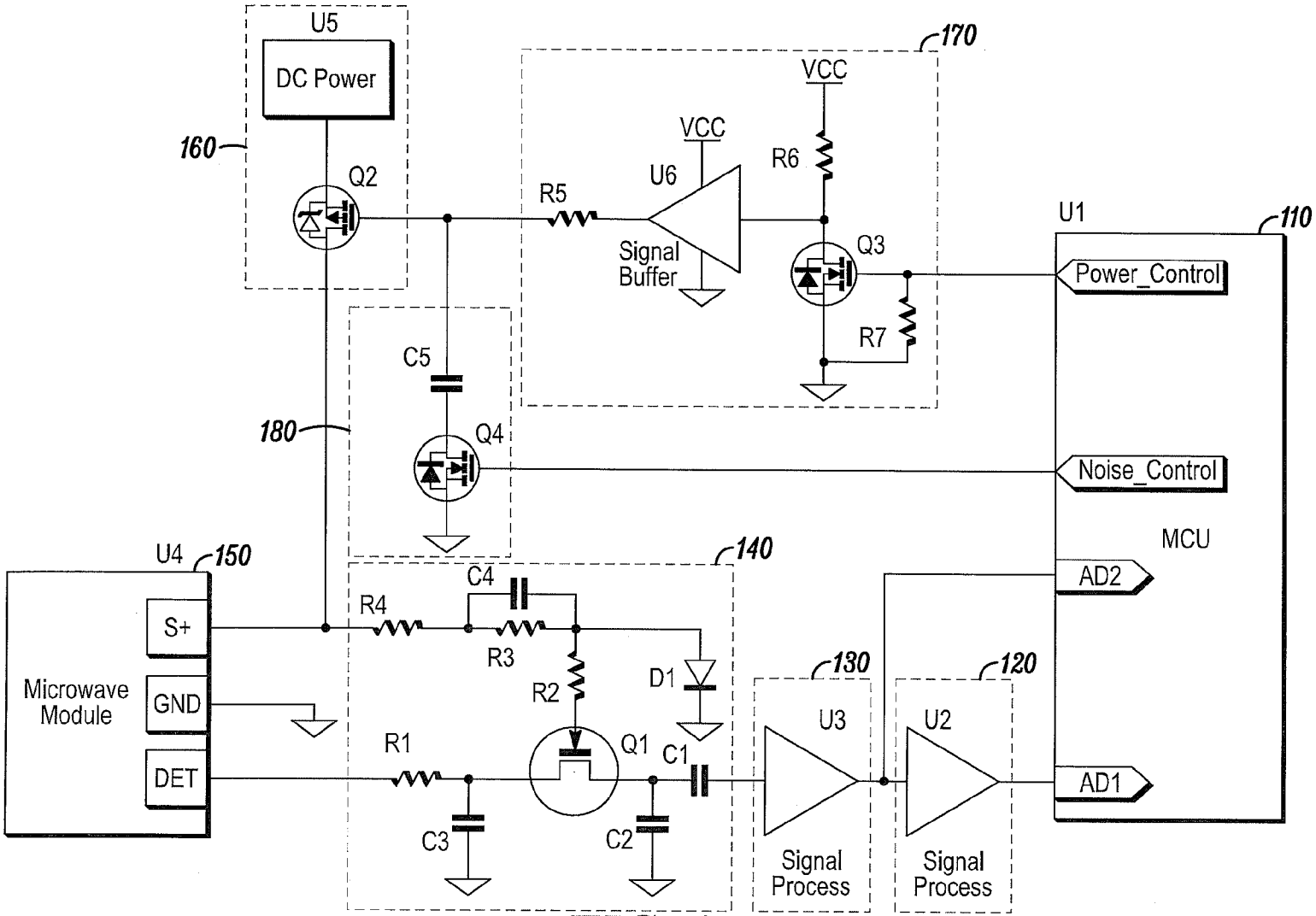
FIG. 1 depicts a intrusion detection system with self-testing in accordance with an illustrated embodiment of the invention.

FIG. 1 shows the block diagram of an intrusion detection system. The system includes: 1) a master control unit (MCU) 110, a second level signal process module 120, a first level signal process module 130, a signal extraction module 140, a microwave module 150, a power module 160, a power drive control module 170, and an adding noise module 180. The direction of arrows represents the signal flow or the control signal flow.

In normal operation for intrusion detection, the master control unit 110 (operating under control of an internal timer) sends a power control signal (e.g., a pulse) through the port "Power_control." The Power Control signal is converted into a drive signal through the power drive control module 170 and used to control the direct current (dc) power module 160. In response to the control signal, the power control module 160 is activated to apply dc to the microwave module 150. In response to the application of dc, the microwave module 150 transmits a microwave signal. Since the drive signal is very short, the drive signal causes the power control module 160 to generate a pulse of dc power that is applied to the microwave module 150.

After the end of the pulse, the microwave module 150 detects that there is an intruder or not by detecting any reflected signal. The reflected signal is mixed with the microwave signal to reduce the reflected signal to baseband. Once reduced to baseband, the only remaining signal is a Doppler signal cased by movement of the intruder. The Dopper signal is output as a corresponding voltage signal. The detected Dopper signal is send to the master control unit 110 through the signal extraction module 140 (where the Doppler signal is bandpass filtered to remove any artifacts) and the two signal amplification processes (120 and 130). The detected result is then processed within the master control unit 110.

In order to ensure the integrity of the intrusion detection capabilities of the microwave module 150, the module 150 may be periodically self-tested. In self-testing, the MCU 110 automatically and periodically initiates a series of steps that self-test the module 150 for proper operation. In this case, the master control unit 110 sends a power control signal that is the same as the normal pulse control signal (for intrusion detection) through the port "Power_control." At the same instant, a noise control signal is generated through the port "Noise_control." The normal pulse control and noise control signal are superimposed via operation of the switch Q4. In this case, the superimposed noise control signal functions to reduce the magnitude of the voltage of the dc pulse that would otherwise be applied to the microwave module 150 during normal operation. This reduced voltage dc pulse causes the microwave module 150 to emit a weak microwave noise pulse.

The two superimposed signals control the power module 160 via the power drive control module 170 and the noise module 180 in order to cause the microwave module 150 generate the noise power microwaves. The module 150 outputs the corresponding weak signal in response to the microwave noise pulse of low power. The noise pulse, in turn, generates a weak signal on the detector (DET) output of the microwave module 150 that is bandpass filtered in the signal extraction module 140 and amplified in the first amplifier 130 to generate a supervisory signal that, in turn, transferred to the AD2 port. The MCU 110 determines whether the microwave and its hardware are functioning normally (or not) based upon the sampling of the supervisory signal received at the MCU input AD2 and by comparing the sampled noise signal with a predetermined fault threshold value.

This self-test process described above in conjunction with FIG. 1 has been found to be less than effective for a number of reasons including: (1) the microwave power is not easy to control because of the low operating power provided by the two superimposed signal thereby causing a great deal of variability in the supervision signal amplitude and increased difficulty in algorithmic evaluation; (2) the high cost by adding the special noise circuit 180 and (3) the software evaluation is based only on the fault threshold, and there are many conditions that can also cause the supervisory signal to meet the threshold and so there are many factors that can make the self-test method associated with FIG. 1 invalid. For example, a microwave module 150 may be of particularly good quality, yet the signal detected by the AD2 port may still be less than the threshold, resulting in a self-test failure. Interference from the environment of the microwave module 150 or if the module 150 is shorted to the ground may cause the supervision signal to be greater than the threshold resulting in a successful self-test. Therefore, the method described above may not correctly or effectively judge the integrity of the microwave module 150 and its hardware regarding circuit failure.

To solve this problem, a number of improved self-test circuits and systems will now be described. The improved circuits and methods provides self-test methods for the microwave module 150 and its hardware based on the combination of hardware and software functions. A first example of the improved self-test circuits may be shown in general using the simplified block diagram of FIG. 2. The self-test circuit includes: 1) the master control unit (MCU) 210; 2) the signal process unit 220; 3) the microwave module 230; 4) the power module 240 and 5) the power control module 250.

The master control unit 210 is an operating platform for software including one or more programmed processors. The processors of the MCU 210 may execute one or more programs loaded from a non-transitory computer readable medium within the MCU 210. The programmed processors may cause the MCU 210 to send power control signals, acquire supervision signals, and determine whether the microwave module and its hardware circuit is operating normally through the use of one or more software algorithms.

The signal processing unit 220 has certain frequency bandwidth filtering and signal amplification functions. The signal from the microwave module 230 is processed within the signal processing unit 220 to obtain a bandwidth and a range of amplitude that is within the processing capabilities of the AD port.

The microwave module 230 applies microwave detecting technology (including transmitting a microwave signals and detecting a reflected signal) and changes the movement of person (or object) into a Doppler based electrical signal, enabling the detection of the activities of a person (e.g., an intruder). When in self-test, the microwave module 230 is in a static mode.

The power module 240 is a dc power supply and provides stable DC power to the microwave module 230. The power module includes a control port connected to the power control module 250.

The power control module 250 converts a control signal generated by the MCU 210 on the "Power_Control" port into drive signal that control the frequency and duration of power pulses that are supplied to microwave module 230. The direction of arrows in FIG. 2 represents the signal flow or the control signal flow.

The principle of operation of the self-test circuitry will be discussed next. In this regard, the master control unit 210 periodically initiates the self-test by sending a sequence of control signals at a specific frequency through the port "Power_Control." The control signal is converted into a drive signal by the power control module 250 and is, in turn, used to control the power module 240 in order to give a controlled power pulse to the microwave module 230 with the same pulse rate frequency as the control signal frequency. The microwave module 230 remains in the static mode during self-test. IN the self-test mode the input power to the microwave module 230 is attenuated and appears on an output connection to the signal processing module 220. Within the signal processing module 220 the attenuated signal is processed into a frequency and level that is sampled by an analog to digital (AD) converter within the MCU 210. Finally, the software algorithm (executed on a programmed processor) determines whether the microwave module 230 and its hardware circuit are working normally by comparing the sampled value to the appropriate threshold.

Figure 2:
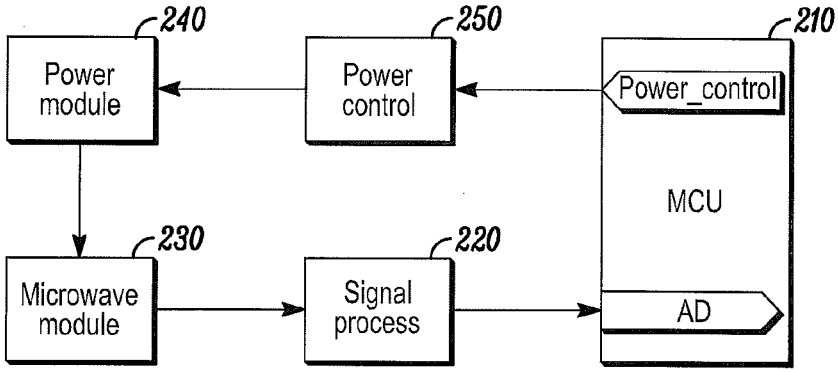
FIG. 2 depicts a simplified block diagram of a self test circuit that may be used with the system of FIG. 1.
Figure 3:
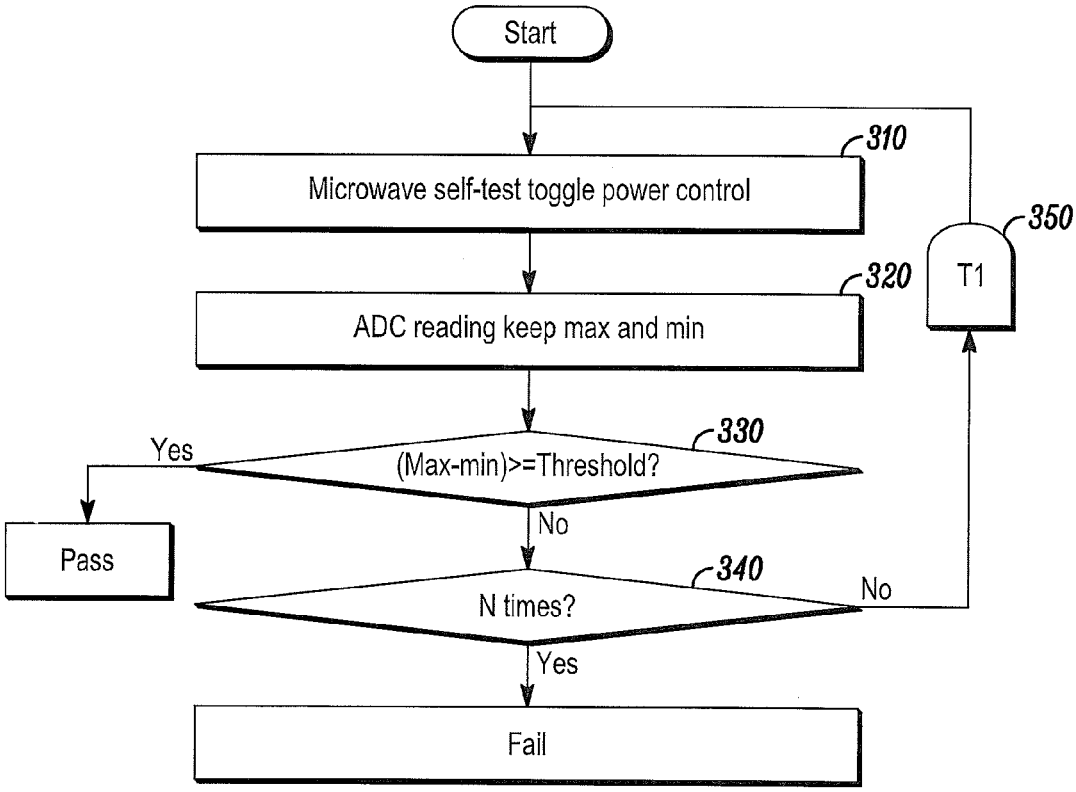
FIG. 3 depicts a flow chart of process steps that may be used by the circuit of FIG. 2.

Software algorithms (executing on one or more programmed processors) for signal control and processing in the system of FIG. 2 are shown in the block diagram of FIG. 3. The processes include: 1) the automatic initiation of the self-test by the MCU 210 is shown as a first step depicted by block 310; 2) the pulsing of the microwave module, the generation of the supervisory signal, the signal sampling and processing steps is depicted by block 320; 3) the results determined step is depicted by block 330; 4) the step of monitoring for the number of processing iterations is depicted by block 340 and 5) the step of establishing a delay time between self-testing is depicted by the block 350. The direction of the arrows represents the direction of program flow.

When the MCU 210 initiates the self-test procedure 310, the system of FIG. 2 performs a number of predetermined steps. In a first step 310, the MCU 210 generates a power control signal that, in turn, results in the return of the supervisory signal. In the next step 320, the MCU 210 reads the supervisory signal via the AD converter selects the maximum "Max" and minimum values "Min." In the next step 330, a results determined unit (processor) within the MCU 210 determines a pass or fail result by comparing the difference between the "Max" and the "Min" with the threshold value. If the difference exceeds the range of the threshold, then the microwave unit 230 has passed the self-test and the system of FIG. 2 is returned to a normal operational state of detecting intruders. Alternatively, if the difference does not exceed the threshold (failure result) then the system proceeds to the next step. In the next step 340, the MCU 210 counts the number of self-test iterations that detect a failure of the microwave module 230. If the number of times (iterations) is more than "N", then the self-test has failed. If the number of iterations is less than N and the supervisory signal is less than the threshold, then the test is repeated. The process step 350 controls the interval time between each tests.

Figure 4:
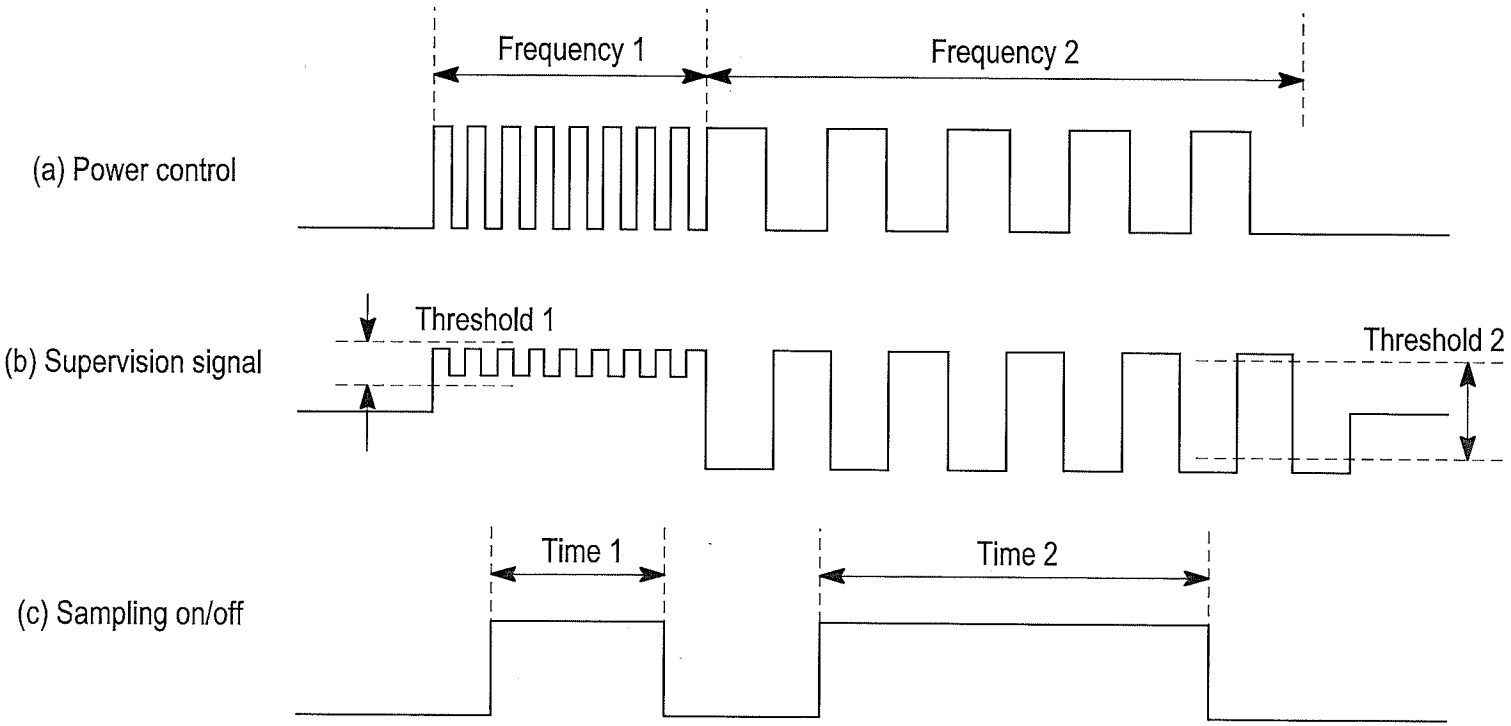
FIG. 4 is a timing diagram of testing pulses that may be used in conjunction with the system of FIG. 1.

FIG. 4 is a timing diagram under which the self-test system of FIG. 2 operates. FIG. 4 (*a*) for the power control signal generated by the Power_Control output of the MCU 210. FIG. 4(*a*) of the diagram shows two control sequences including a first sequence of pulses at a frequency "Frequency1" and a second sequence at a lower frequency "Frequency2." There is no particular requirement for the number of pulses in either sequence. As shown in FIG. 4(*a*), the off portion of the pulse may be of the same duration as the on portion of the pulses of the sequences.

FIG. 4 (*b*) depicts the corresponding monitoring (supervisory) signal returned from the microwave module 230 through the signal processing module 220 to the AD input to the MCU 210. FIG. 4(*b*) indicate the two threshold values that could be used for the supervisory signal. If the supervisory signal (Threshold2) exceeds the predetermined threshold, then the self-test passes. Alternatively, a difference value may be calculated by subtracting the smaller value (Threshold1) from the larger value (Threshold2) and the difference compared with the predetermined fault threshold value.

FIG. 4 (*c*) depicts the sampling time period for self-test. As shown, the MCU 210 may select a first sampling time period ("Time1") for the high frequency sequence (Frequency1) and a second sampling time period ("Time2") for the lower frequency sequence (Frequency2). The sampling periods (Time1 and Time2) may be shifted to avoid any artifacts occurring in the beginning and ends of the sequence.

The basic technical concepts of illustrated embodiments of the invention as shown in FIG. 2, including: a master control unit 210, a signal process unit 220, a microwave module 230, a power module 240, and a power control module 250. While FIG. 3 depicts one process that may be used for self-testing, other processes may be used as well for steps 310, 320, 330, 340, 350. Similarly, while the timing diagram of FIG. 4 provides one exemplary timing diagram that could be used for self-testing, other timing diagrams could also be used for the control signal for power, supervision signal, and the sampling timing.

Figure 5:
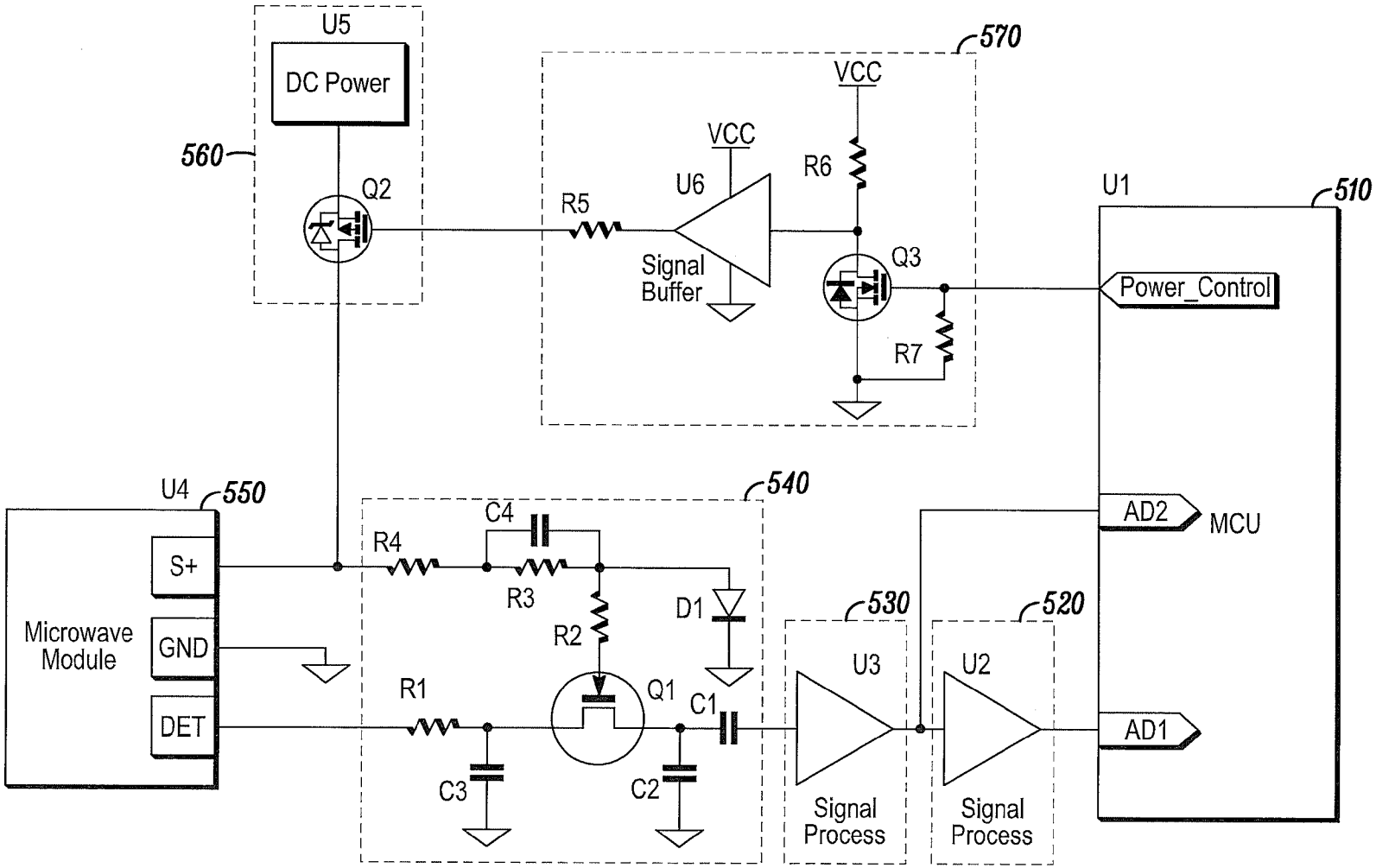
FIG. 5 is a simplified schematic of the self-testing circuit diagram of FIG. 2 under a preferred embodiment.

FIG. 5 depicts a first, more detailed schematic of a preferred embodiment of the self-testing system of FIG. 2. FIG. 5 includes: 1) a master control unit 510; 2) a second level signal amplification processing module 520; 3) a first level signal amplification processing module 530; 4) a signal extraction module 540; 5) a microwave module 550; 6) a power module 560 and 7) a power drive control module 570.

Figure 6:
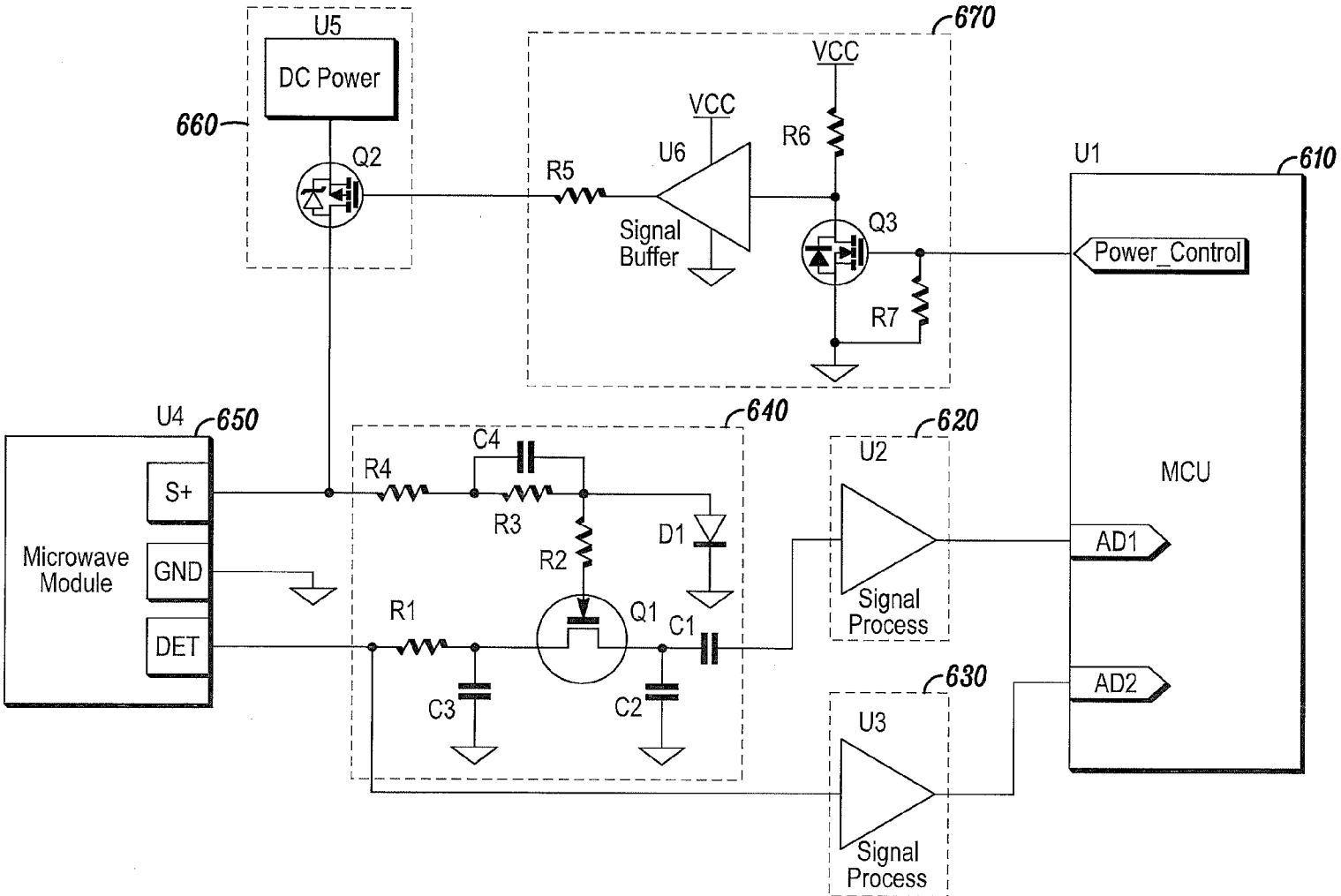
FIG. 6 is a simplified schematic of the self-testing circuit diagram of FIG. 2 under another preferred embodiment.

FIG. 6 depicts a second, more detailed schematic of a second preferred embodiment of the system of FIG. 2. FIG. 5 includes: 1) a master control unit 610; 2) a working signal amplification processing module 620; 3) a supervision signal amplification processing module 630; 4) a signal extraction module 640; 5) a microwave module 650; 6) a power module 660 and 7) a power drive control module 670.

Figure 7:
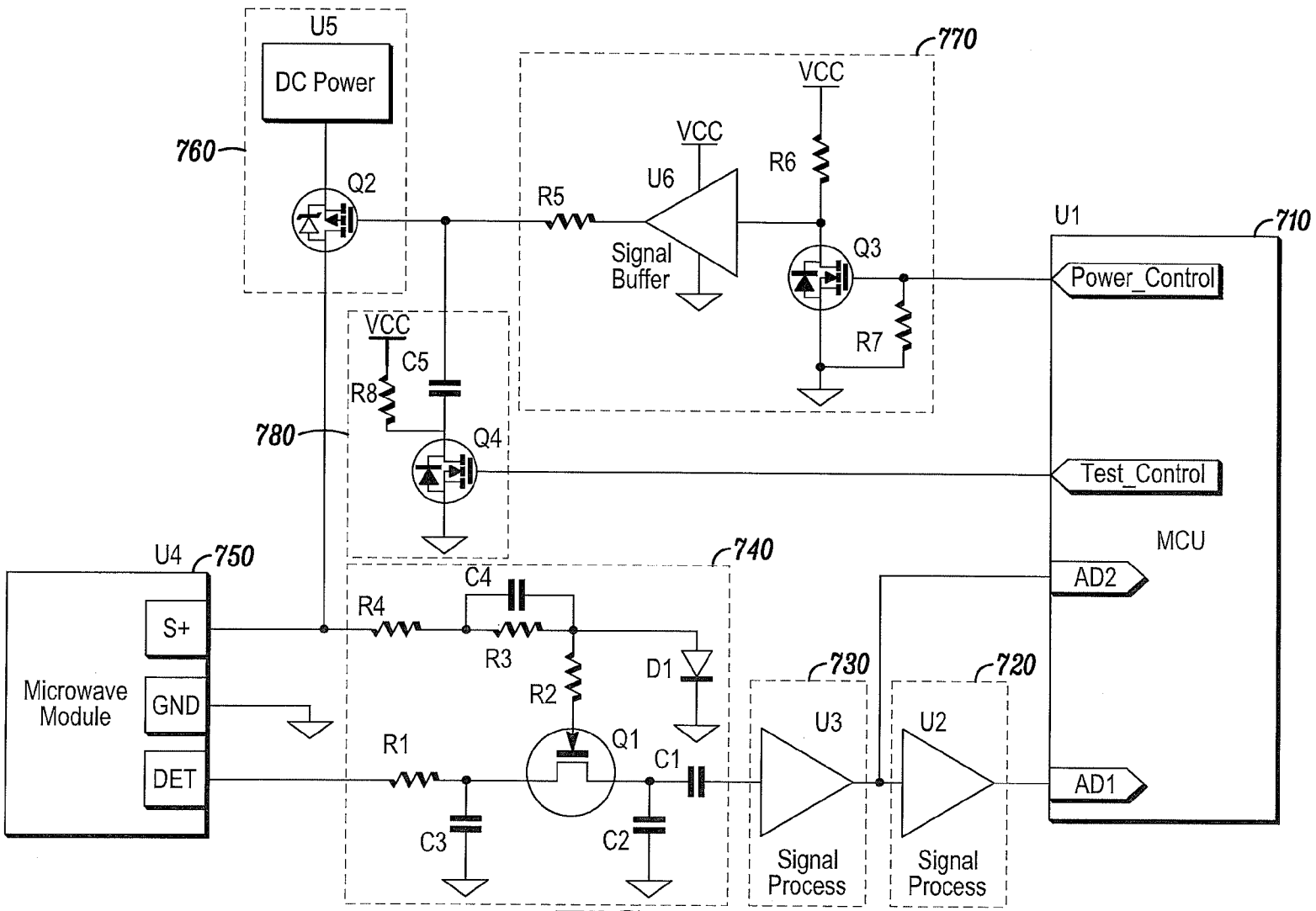
FIG. 7 is a simplified schematic of the self-testing circuit diagram of FIG. 2 under another preferred embodiment.

FIG. 7 depicts a third, more detailed schematic of a third preferred embodiment of the system of FIG. 2. FIG. 5 includes: 1) a master control unit 710; 2) a working signal amplification processing module 720; 3) a supervision signal amplification processing module 730; 4) a signal extraction module 740; 5) a microwave module 750; 6) a power module 760; 7) a power drive control module 770 and 8) a test power control module 780.

In the examples of FIGS. 3-7, the MCU can gradually change the frequency of the pulse sequences, that is, the power control signal frequency can be decreased or increased according to the application. The change in frequency of the pulse sequences causes a corresponding gradually change in the supervision signal amplitude. The corresponding decision threshold can be adjusted to follow the changing frequency.

In the examples of FIGS. 3-7, the control signal during self-test may be provided as a single sequence of pulses of an adjustable frequency, that is, the frequency of the power control signal is a single frequency, but is adjusted according to the needs of the self-test. This generates a supervisory signal under a single frequency format, but the signal amplitude threshold can be adjusted according to that signal amplitude.

In the examples of FIGS. 3-7, the duty cycle of the power control signal can be adjusted. The control signals can also be converted from a square wave signal into a trapezoidal, triangular or sine wave format.

The power control signal in self-test of the preferred embodiments of FIGS. 5-7 is different than the self-test system of FIG. 1. Because the specific frequency of the self-test signal is used to replace the add noise control of FIG. 1, the power frequency for the microwave module can be controlled during self-test. This causes the output signal from the microwave module to be more controllable and is easier to process by the AD circuit (port) of the MCU.

The design of FIG. 5 removes the noise adding module 180. This can reduce cost and simplify the software algorithms.

The design of FIG. 6 uses a special circuit for supervision. This makes it easier to choose the frequency and to control the power, and this makes the supervision signal amplitude more controllable.

The design of FIG. 7 is similar to FIG. 1, but with minor changes. FIG. 7 uses the circuit 180 for generating a control signal instead of for the generation of a noise signal. This can achieve better control of the power from the microwave module.

The determination method of the self-test methods of FIGS. 5-7 is different than the methods of FIG. 1. The designs of FIGS. 5-7 can use a self-test method with the "multi-frequency band-multi-threshold value", and this will be more accurate for the judgments of integrity of microwave modules and their hardware function.

Turning now to the specific features of the preferred embodiment, FIG. 5 includes: 1) a master control unit 510; 2) a second level signal amplification processing module 520; 3) a first level signal amplification processing module 530; 4) a signal extraction module 540; 5) a microwave module 550; 6) a power module 560 and 7) a power drive control module 570. The compositions of each module are shown in FIG. 5.

In use, the master control unit 510 sends a power control signal for normal operation (i.e., intrusion detection) through the port "Power_Control." The power control signal (at a specific pulse frequency) is converted into control signal that can drive the switch "Q2" through the power drive control module 570. The drive control signal controls the duration of power to the microwave module 570 through the power module 560. When there is a motion or other behavior of a person or object within the protected area, the microwave module begins to work, to convert the "behavior" into a smaller Doppler voltage signal, and the smaller signal is extracted into a band signal (or called take cover) through the signal extraction module 540. Then, the extracted signal is processed into a larger signal which "AD1" receives through the first level signal amplification processing module 530 and the second level signal amplification processing module 520. Finally, the MCU determines whether the "behavior" is made by an intruder according to the sampling signal received through "AD1" and by comparison of the Doppler signal with an intrusion threshold.

Periodically, the MCU 510 enters the self-test mode. First, the master control unit 510 sends a self-test control signal with the frequency changing gradually through the port "Power_Control." The self-test frequency is different with the normal working frequency. The control signal is converted into drive control signal that can drive the switch "Q2" through the power drive control module 570. The drive control signal control the power supplied to the microwave module 570 through control of activation of the power module 560. In this static mode, the microwave module 550 output a corresponding weak signal with the same frequency. The weak signal is extracted by the signal extraction module 540, and forms a signal with a certain corresponding frequency. The extraction supervision signal is enlarged into an acceptable range for application to the "AD2" port through the first level signal amplification processing module 530. The supervision signal is then sampled by the AD converter of the "AD2" port, and the MCU 510 determines whether the microwave module and its hardware circuit is working normally according to the algorithm described in conjunction with FIG. 3 and the signal sampling timing described in FIG. 4.

The self-test using the preferred embodiment of FIG. 6 will be discussed next. The design of FIG. 6 includes: 1) a master control unit 610; 2) a working signal amplification processing module 620; 3) a supervision signal amplification processing module 630; 4) a signal extraction module 640; 5) a microwave module 650; 6) a power module 660 and 7) a power drive control module 670. The difference between the design of FIG. 6 and FIG. 1 involves three factors. First, the removal of the special circuit for adding noise reduces costs. Second, it is helpful for selective frequency processing to use a special circuit for generating the supervision signal, that is, the circuit of FIG. 6 is more flexible in selecting the power control frequency, and does not rely on the signal channel bandwidth. Third, the power control and supervision data may be evaluated in different ways.

The self-test using the preferred embodiment of FIG. 7 will be discussed next. The design of FIG. 7 includes: 1) a master control unit 710; 2) a working signal amplification processing module 720; 3) a supervision signal amplification processing module 730; 4) a signal extraction module 740; 5) a microwave module 750; 6) a power module 760; 7) a power drive control module 770 and 8) a self-test power control module 780. The difference between the design of FIG. 7 and FIG. 1 includes a number of factors. First, when the microwave module is in self-test state, the port "Power_control" is maintained in a DC state. In this state, the power control signal for self-test is generated by the port "Test_control." This is used to achieve self-test function.

Figure 8A:
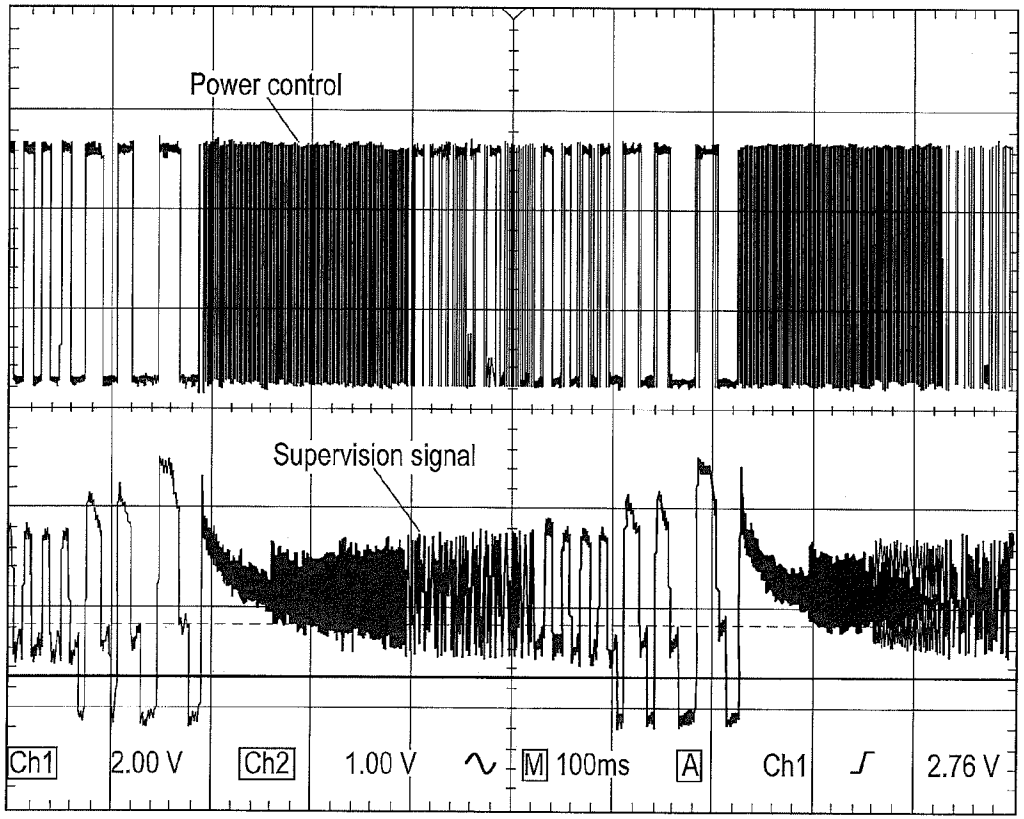
FIG. 8 shows comparative data of the self-testing circuits of FIGS. 5-7 using a variable test frequency.
Figure 8B:
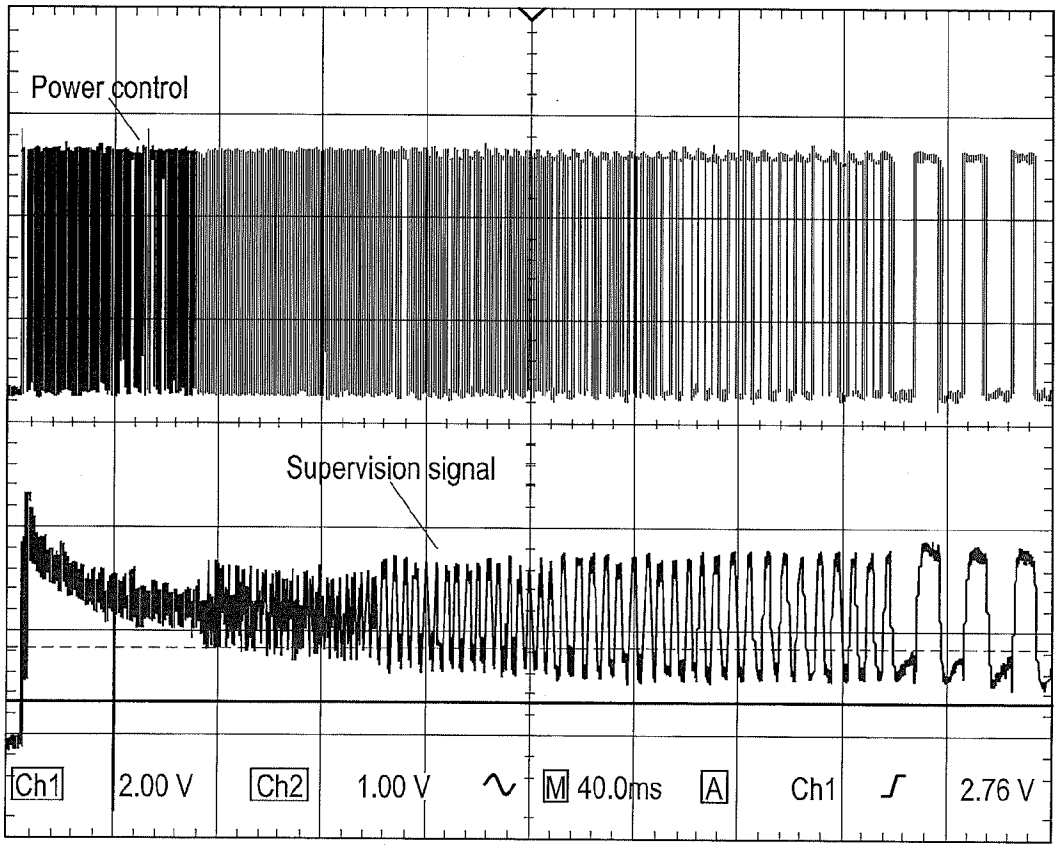

The performance of the self-test circuits of FIGS. 5-7 may be demonstrated in any of a number of ways. For example, FIG. 8 may be used to depict the concepts of FIGS. 5-7. The upper part of FIG. 8 is the power control signal, and the lower part is supervision or supervisory signal. From FIG. 8 it can be seen that, with the frequency of power control signal decreasing gradually, the amplitude of supervision signal gradually increases. That is, when the frequency is decreased from 750 Hz to 30 Hz, the signal amplitude increasing from 0.2 V to 2.4 V. In this case, the difference (Theshold2−Theshold1) is 2.0 V. The self-test threshold may be set for some nominal amount less than 2.0 V to pass the self-test.

Figure 9B:
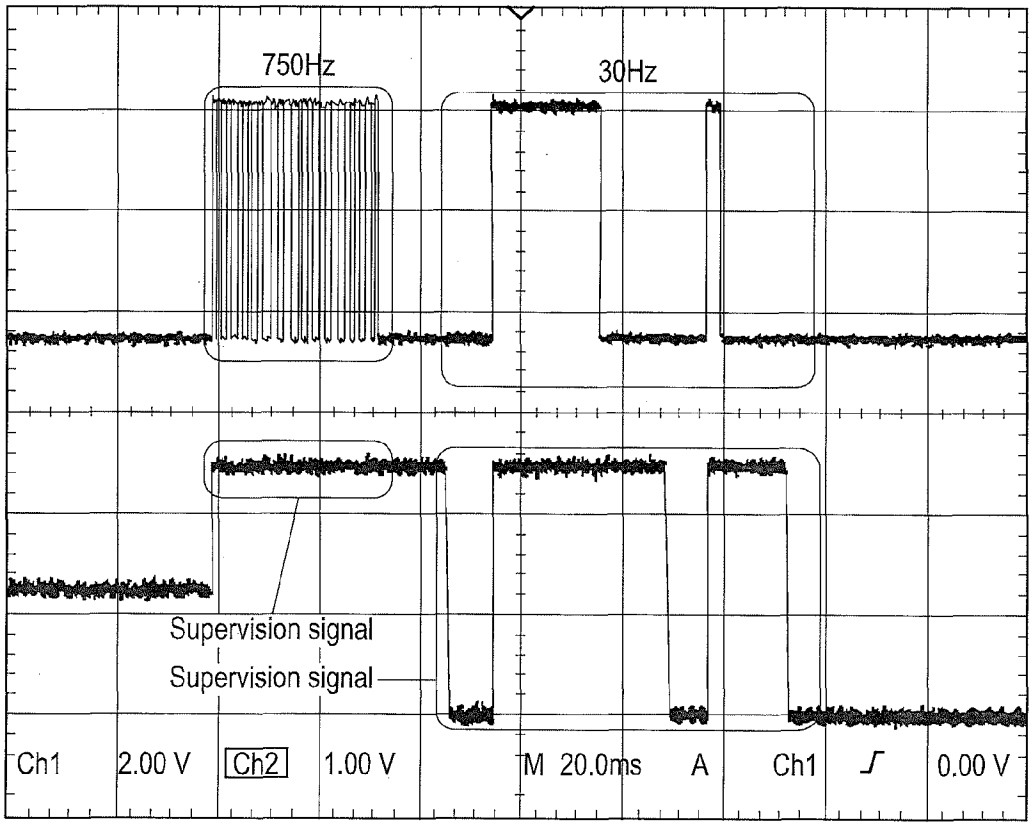
FIG. 9 shows comparative data of the self-testing circuits of FIGS. 5-7 using two test frequencies.
Figure 9C:
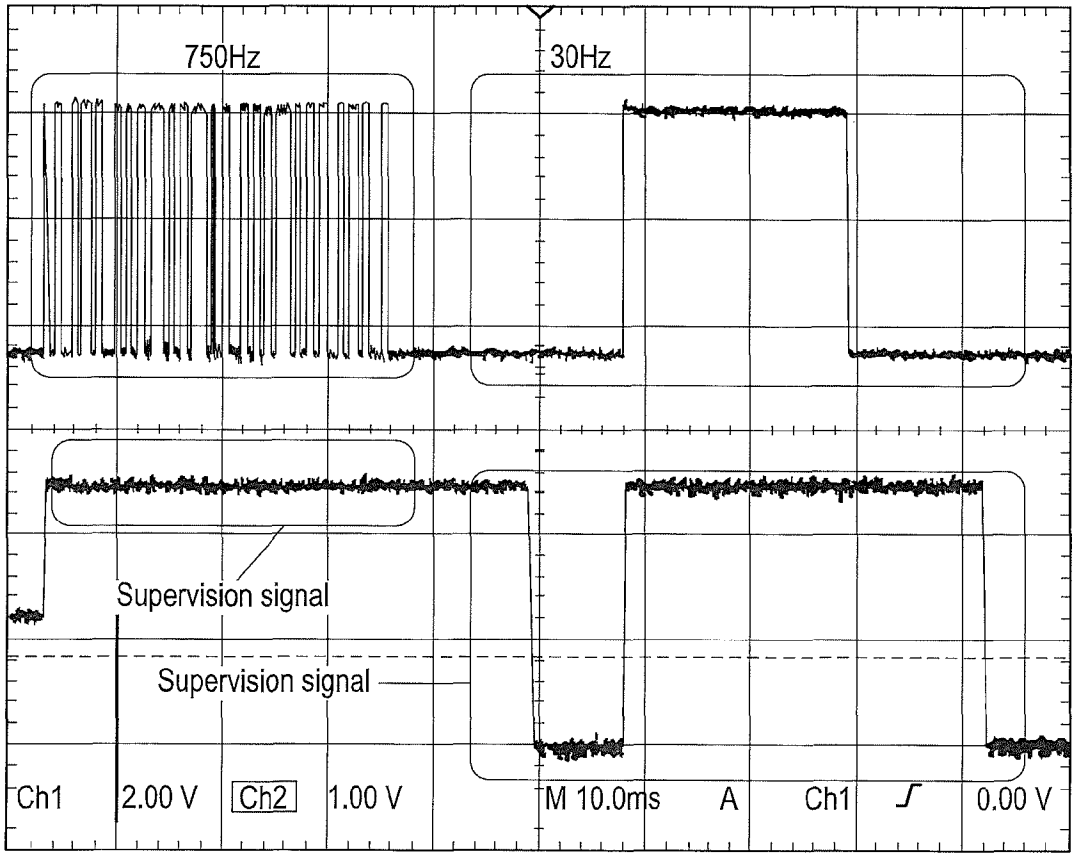

Shown in FIG. 9 is the example depicted in FIG. 4 including a Frequency1 of 750 Hz and a Frequency2 of 30 Hz. In this case, the maximal amplitude of supervision signals value about 0.2 V and 2.4 V.

Figure 10A:
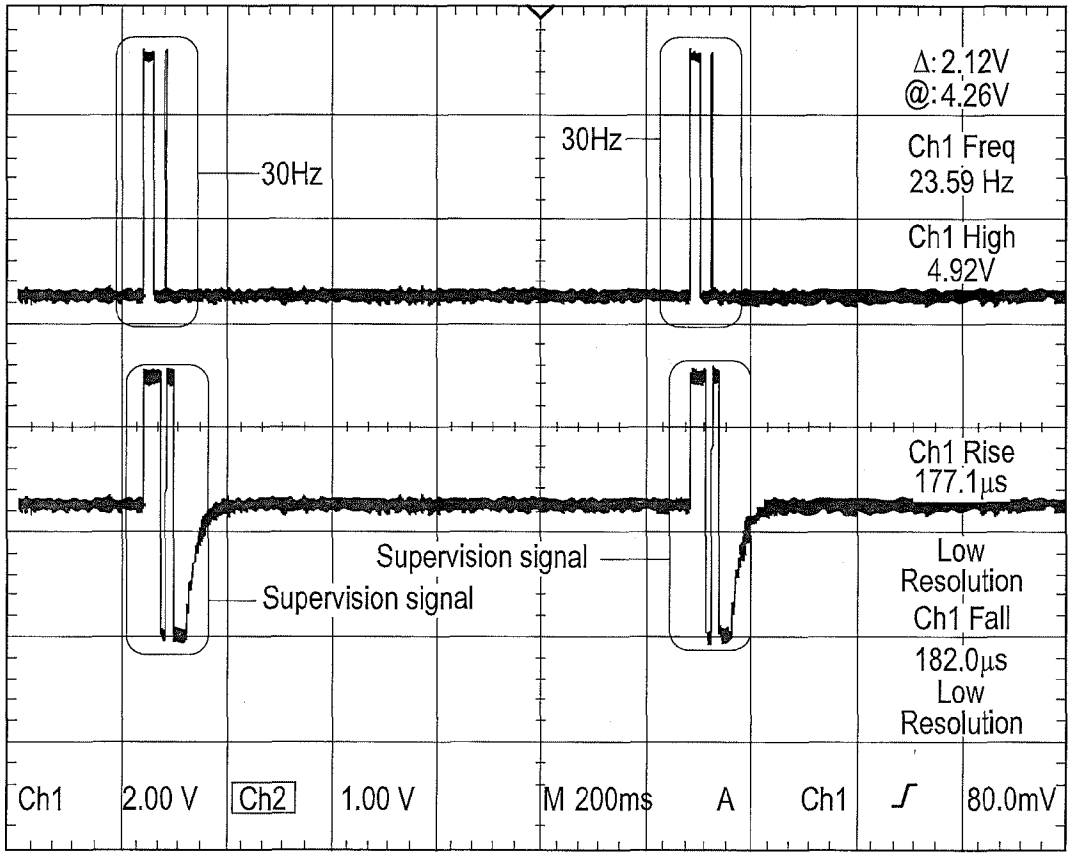
FIG. 10 shows comparative data of the self-testing circuits of FIGS. 5-7 using a single test frequency.
Figure 10B:
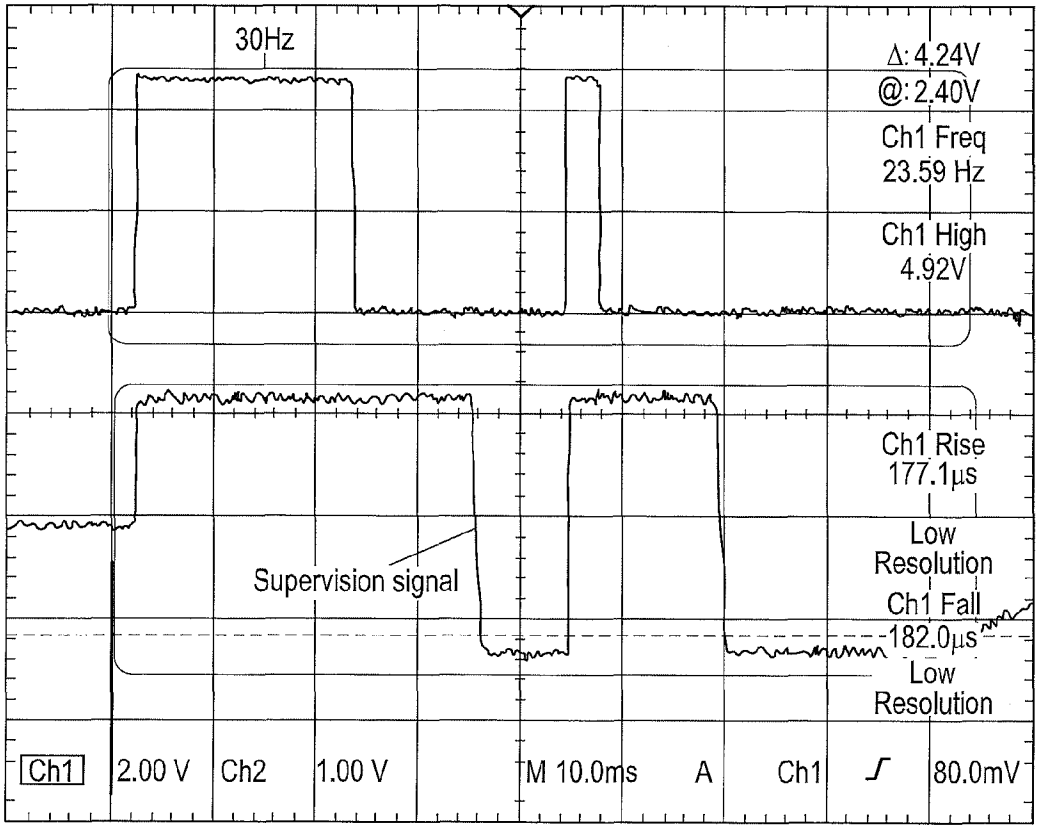

Shown in FIG. 10 is an example where only a single frequency 30 Hz is used. In this case, the supervisory signal value about 2.4 V. Therefore, by controlling the frequency of the input signal, the MCU can determine whether the microwave and its hardware circuit work normally according to the scope of the supervision signal amplitude, in this case comparing the supervisory signal with a threshold value that is somewhat less than 2.4 V.

A specific embodiment of method and apparatus for self-testing a microwave intrusion detector has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method comprising:

detecting intruders within a protected space by monitoring a Doppler output of a signal extraction circuit coupled to a microwave transceiver module;

varying a frequency of direct current power pulses applied to the microwave transceiver module;

detecting a difference in magnitude of the Doppler output of the signal extraction circuit over the varied frequency; and comparing the detected difference with a fault threshold level.

2. The method as in claim 1 wherein the step of varying a frequency further comprises applying the direct current power at a first pulse rate for a first predetermined time period and then applying the direct current power at a second pulse rate for a second predetermined time period.

3. The method as in claim 2 wherein the first pulse rate further comprises 750 Hz.

4. The method as in claim 2 wherein the first pulse rate further comprises 30 Hz.

5. The method as in claim 2 further comprising repeating the application of first and second pulse rates for the first and second timer periods upon detecting that the difference does not exceed the threshold.

6. The method as in claim 5 further comprising generating a fault notice upon detecting that the difference does not exceed the threshold after a predetermined number of repetitions of the first and second pulse rates.

7. The method as in claim 2 further comprising periodically applying the first and second pulse rates to test the microwave module.

8. Apparatus comprising:

a microwave transceiver module that detects intruders within a protected space;

a signal extraction circuit coupled to an output of the microwave transceiver module that generates a Doppler output;

a first programmed processor that varies a frequency of direct current power pulses applied to the microwave transceiver module;

a second programmed processor that detects a difference in magnitude of the Doppler output of the signal extraction circuit over the varied frequency; and a third programmed processor that compares the detected difference with a fault threshold level.

9. The apparatus as in claim 8 wherein the processor that varies the frequency further comprises a power controller that applies the direct current power at a first pulse rate for a first predetermined time period and then applying the direct current power at a second pulse rate for a second predetermined time period.

10. The apparatus as in claim 9 wherein the first pulse rate further comprises 750 Hz.

11. The apparatus as in claim 9 wherein the first pulse rate further comprises 30 Hz.

12. The apparatus as in claim 9 further comprising a processor that repeats the application of first and second pulse rates for the first and second timer periods upon detecting that the difference does not exceed the threshold.

13. The apparatus as in claim 12 further comprising a processor that generates a fault notice upon detecting that the difference does not exceed the threshold after a predetermined number of repetitions of the first and second pulse rates.

14. The apparatus as in claim 9 further comprising a processor that periodically applies the first and second pulse rates to test the microwave module.

15. Apparatus comprising:

a microwave transceiver module of a security system that detects intruders within a protected space;

a signal extraction circuit coupled to an output of the microwave transceiver module that couples a Doppler output from the microwave transceiver to an output connection of the signal extraction circuit;

a first programmed processor that applies a sequence of direct current power pulses to the microwave transceiver module at a predetermined number of pulses per time period;

a second programmed processor coupled to the output connection of the signal extraction circuit that detects a magnitude of the output; and a third programmed processor that compares an output of the signal extraction circuit with a fault threshold level.

16. The apparatus as in claim 15 wherein the first programmed processor applies a first sequence of direct current pulses to the microwave transceiver module at the predetermined number of pulses per time period followed by a second sequence of direct current pulses microwave transceiver module at another, different predetermined number of pulses per time period.

17. The apparatus as in claim 15 further comprising a power module that couples dc power to the microwave module under control of the first programmed processor.

18. The apparatus as in claim 17 further comprising a power drive control module connected between the first programmed processor and the power module.

19. The apparatus as in claim 18 further comprising a self-test power control module connected between the first programmed processor and the power module in parallel with the power drive control module.

20. The apparatus as in claim 15 further comprising a timer that periodically initiates a test of the microwave module.

* * * * *